US009747841B2

(12) United States Patent
Kumeta et al.

(10) Patent No.: US 9,747,841 B2
(45) Date of Patent: Aug. 29, 2017

(54) ELECTRO-OPTICAL DEVICE AND DRIVING METHOD THEREOF

(71) Applicant: SAMSUNG DISPLAY CO., LTD., Yongin, Gyeonggi-Do (KR)

(72) Inventors: Masayuki Kumeta, Yokohama (JP); Takeshi Okuno, Yokohama (JP); Eiji Kanda, Yokohama (JP)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 205 days.

(21) Appl. No.: 14/278,010

(22) Filed: May 15, 2014

(65) Prior Publication Data

US 2014/0340436 A1 Nov. 20, 2014

(30) Foreign Application Priority Data

May 16, 2013 (JP) ..... 2013-104039

(51) Int. Cl.
*G09G 3/30* (2006.01)
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2310/0248* (2013.01); *G09G 2310/08* (2013.01); *G09G 2320/029* (2013.01); *G09G 2320/0285* (2013.01); *G09G 2320/045* (2013.01)

(58) Field of Classification Search
CPC ..... G09G 2300/043; G09G 3/30–3/3291
See application file for complete search history.

(56) References Cited

U.S. PATENT DOCUMENTS

2011/0169798 A1* 7/2011 Lee ..... G09G 3/3233 345/211
2013/0293600 A1* 11/2013 Lee ..... G09G 3/3258 345/691

FOREIGN PATENT DOCUMENTS

| | | | |
|---|---|---|---|
| JP | 2005-115144 | A | 4/2005 |
| JP | 2007-240694 | A | 9/2007 |
| JP | 2009-008799 | A | 1/2009 |
| JP | 2010-170079 | A | 8/2010 |
| JP | 2012-022329 | A | 2/2012 |

* cited by examiner

*Primary Examiner* — Hang Lin
(74) *Attorney, Agent, or Firm* — Lee & Morse, P.C.

(57) ABSTRACT

An electro-optical device selects a detection target pixel independently and obtains correction data to perform a correction operation. Under a control of the electro-optical device, remaining pixels other than the detection target pixel emit light to display an image.

3 Claims, 21 Drawing Sheets

Relation between applying current and source voltage when driving TFT operates in saturation region Relation between applying current and source voltage when driving TFT operates in linear region

ELECTRO-OPTICAL DEVICE AND DRIVING METHOD THEREOF

CROSS-REFERENCE TO RELATED APPLICATION

Japanese Patent Application No. 2013-104039, filed on May 16, 2013, and entitled: "Electro-Optical Device and Driving Method Thereof," is incorporated by reference herein in its entirety.

BACKGROUND

1. Field

One or more embodiments described herein relate to an electro-optical device.

2. Description of the Related Art

An electro-optical device displays images using a plurality of pixels. Each pixel has a driving transistor to control an emission state of an organic electroluminescence (EL) element.

The brightness of luminescence of the EL element may vary according to a current value. The driving transistor changes brightness of the EL element by varying a drain current based on an image signal. If a threshold voltage of a driving transistor in each pixel varies, or luminescence characteristic of the EL element changes over time, the brightness of each pixel will vary to thereby degrade display quality.

SUMMARY

In accordance with one embodiment, a panel includes a plurality of pixels arranged in a row direction and column direction, each of the pixels including: a driving transistor having a drain electrode connected to an anode of an organic electroluminescence (EL) element, a selection transistor to control connection between a gate electrode of the driving transistor and a data signal line, a first switching transistor to control connection between a source electrode of the driving transistor and a power line for supplying current to the EL element, and a second switching transistor to control connection between the source electrode of the driving transistor and the data signal line.

During a data programming period, the selection transistor is turned on and a data voltage is provided from the data signal line to the gate electrode of the driving transistor. During an emission period, the source electrode of the driving transistor of a detection target pixel is connected to the data signal line by turning off the first switching transistor and turning on the second switching transistor of the detection target pixel, so that detection current is provided to the driving transistor from the data signal line.

In each of the pixels in a same row as the detection target pixel, the source electrode of the driving transistor is connected to the data signal line by turning off the first switching transistor and turning on the second switching transistor, so that a same power supply voltage on the power line is provided to the driving transistor from the data signal line. In each of the pixels in a row different from the detection target pixel, the source electrode of the driving transistor is connected to the power line by turning on the first switching transistor and turning off the second switching transistor, so that the EL element emits light.

In accordance with another embodiment, a method is provided for driving a panel having a plurality of pixels arranged in a row direction and a column direction. The method includes data programming each of the pixels, the data programming including, for each of the pixels, providing a gate potential from a data signal line to a gate electrode of a driving transistor, the driving transistor having a drain electrode connected to an anode of an organic electroluminescence (EL) element.

During an emission period in which the EL elements of the pixels simultaneously emit light, the method includes providing a detection current to a source electrode of the driving transistor of a detection target pixel from the data signal line, detecting a voltage of the source electrode of the driving transistor of the detection target pixel when the driving transistor operates in a saturation region or linear region, connecting the source electrode of the driving transistor to a power line for simultaneous emission of the EL elements in remaining ones of the pixels, with a potential of the gate electrode of the driving transistor charged.

In accordance with another embodiment a method is provided for driving a panel having a plurality of pixels arranged in a row direction and a column direction. During data programming, the method includes sequentially performing in 1-frame period for each of the pixels: providing a gate potential from a data signal line to a gate electrode of a driving transistor, the driving transistor having a drain electrode connected to an anode of an organic electroluminescence (EL) element.

During an emission period, the method includes connecting a source electrode of the driving transistor to a power line for emission of the EL element from a pixel for which data programming is ended, with a potential of the gate electrode of the driving transistor charged. Also, during the emission period, the method includes providing a source current to the source electrode of the driving transistor of a detection target pixel from the data signal line, and detecting a voltage of the source electrode of the driving transistor when the driving transistor operates in a saturation region or linear region.

In accordance with another embodiment, an electro-optical device includes a panel including a plurality of pixels arranged in a row direction and a column direction, each of the pixels including a driving transistor having a drain electrode connected to an anode of an organic electroluminescence (EL) element, each pixel arranged in the column direction connected to a data signal line and a power line extending in the column direction; a data driver to output a data signal to the data signal line of each of the pixels; and a correction value detecting circuit to supply current to source electrode of the driving transistor of a detection target pixel and detect a correction value.

The correction value detecting circuit detects a threshold voltage of the driving transistor from a voltage of the source electrode of the driving transistor of the detection target pixel obtained when the driving transistor operates in a saturation region, or a voltage-current characteristic of the EL element from a voltage of the source electrode of the driving transistor of the detection target pixel obtained when the driving transistor operates in a linear region.

Each of the pixels includes a switching transistor to connect, to the data signal line, the source electrode of the driving transistor of the detection target pixel and the source electrode of the driving transistor of each of remaining pixels in a same row as the detection target pixel, and to connect, to the power line, the source electrode of the driving transistor of each of the pixels in a different row from the detection target pixel. When the remaining pixels other than the detection target pixel emits light, the correction value detecting circuit detects a threshold voltage of the driving transistor or a voltage-current characteristic of the EL element in the detection target pixel.

The device may include a switch circuit to switch a connection location of the data signal line, wherein the switch circuit is to connect the data signal line to the data driver during a data programming period in which a data voltage is written at a gate electrode of the driving transistor of each pixel, to connect the data signal line to the power line during an emission period in which each of the pixels emit light, and to connect the data signal line to the correction value detecting circuit when a source current is supplied to source electrode of driving transistor of the detection target pixel.

The pixel circuit may include a detection signal line connected to a source electrode of a driving transistor of one of the pixel in the column direction; and a switch circuit to switch a connection location of the detection signal line, wherein the switch circuit is to connect the detection signal line to the correction value detecting circuit when a source current is supplied to the source electrode of the driving transistor and to connect the detection signal line to the power line during an emission period in which each pixel emits light.

In accordance with another embodiment, a method is provided for driving an electro-optical device having a plurality of pixels arranged in a column direction and a row direction. During data programming, for each of the pixels, the method includes providing a gate potential from a data signal line to a gate electrode of a driving transistor, the driving transistor having a drain electrode connected to an anode of an organic electroluminescence (EL) element, and connecting a source electrode of the driving transistor to a power line for emission of light from the EL element, when a potential of the gate electrode of the driving transistor charged.

During a simultaneous emission period, the method includes setting an address of a detection target pixel corresponding to a correction value, supplying current to the source electrode of the driving transistor in the detection target pixel, and detecting a threshold voltage of the driving transistor from a voltage of the source electrode of the driving transistor obtained when the driving transistor operates in a saturation region, or a detecting voltage-current characteristic of the EL element from a voltage of the source electrode of the driving transistor obtained when the driving transistor operates in a linear region; and generating correction data of the threshold voltage of the driving transistor or correction data of the EL element from the detected data value.

During a period in which the EL elements of all the pixels simultaneously emit light, the method includes connecting the power line to the source electrode of the driving transistor in remaining ones of the pixels other than the detection target pixel in a row of the detection target pixel, and connecting the data signal line to the source electrode of the driving transistor at a same time when the data signal line is connected to the power line, for pixels in the row of the detection target pixel.

In accordance with another embodiment, a method is provided for driving an electro-optical device having a plurality of pixels arranged in a row direction and a column direction. The method includes sequentially performing data programming in a 1-frame period for each of the pixels, including providing a gate potential from a data signal line to a gate electrode of a driving transistor, the driving transistor having a drain electrode connected to an anode of an organic electroluminescence (EL) element, and connecting a source electrode of the driving transistor to a power line for emission of light from the EL element of a pixel for which the data programming has ended, with potential of the gate electrode of the driving transistor charged.

During the 1-frame period, the method includes setting an address of a detection target pixel corresponding to a correction value, supplying current to the source electrode of the driving transistor in the detection target pixel, and detecting a threshold voltage of the driving transistor from a voltage of the source electrode of the driving transistor obtained when the driving transistor operates in a saturation region, or detecting a voltage-current characteristic of the EL element from a voltage of the source electrode of the driving transistor obtained when the driving transistor operates in a linear region; and generating correction data of the threshold voltage of the driving transistor or correction data of the EL element from the detected data value.

During the 1-frame period, the power line is connected to the source electrode of the driving transistor in remaining ones of the pixels other than the detection target pixel in a row of the detection target pixel, and the data signal line is connected to the power line at a same time when the data signal line is connected to the source electrode of the driving transistor, in remaining ones of pixels in the row of the detection target pixel.

In accordance with another embodiment, an apparatus is provided for controlling an electro-optical device having a plurality of pixels arranged in rows and columns. The apparatus includes a selector to select a detection target pixel independently from other pixels in a same row; a switch to provide a data voltage to a data line of the detection target pixel during a data programming period and to provide a detection current to the data line of the detection target pixel exclusive of other ones of the pixels; a detector to detect a threshold voltage of a driving transistor of the detection target pixel when the driving transistor is operating in a saturation region, or a voltage-current characteristic of an electroluminescence (EL) element of the detection target pixel when the driving transistor is operating in a linear region; and a corrector to correct for a variation in the detected threshold voltage or the voltage-current characteristic of the EL element of the detection target pixel.

Each pixel may include a switching transistor to connect, to the data signal line, a source electrode of a driving transistor of the detection target pixel and a source electrode of a driving transistor of each of remaining pixels in a same row as the detection target pixel, and to connect, to a power line, the source electrode of the driving transistor of each of the pixels in a different row from the detection target pixel.

The detector may detect the threshold voltage of the driving transistor or a voltage-current characteristic of the EL element in the detection target pixel when one or more of the other pixels emit light.

Each pixel may include a driving transistor having a drain electrode connected to an EL element anode, a selection transistor to control connection between a gate electrode of the driving transistor and a data signal line, a first switching transistor to control connection between a source electrode of the driving transistor and a power line for supplying current to the EL element, and a second switching transistor to control connection between the source electrode of the driving transistor and the data signal line.

During a data programming period of each pixel, the selection transistor may be turned on and a data voltage may be provided from the data signal line to the gate electrode of the driving transistor. During an emission period, the source electrode of the driving transistor of the detection target pixel may be connected to the data signal line, by turning off the first switching transistor and turning on the second switching transistor of the detection target pixel, to provide the detection current to the driving transistor from the data signal line.

In accordance with another embodiment, a method is provided for controlling an electro-optical device having a plurality of pixels arranged in rows and columns. The method includes selecting a detection target pixel independently from other pixels in a same row; providing a data voltage to a data line of the detection target pixel during a data programming period, and providing a detection current to the data line of the detection target pixel exclusive of other ones of the pixels; detecting a threshold voltage of a driving transistor of the detection target pixel when the driving transistor is operating in a saturation region, or a voltage-current characteristic of an electroluminescence (EL) element of the detection target pixel when the driving transistor is operating in a linear region; and correcting for a variation in the detected threshold voltage or the voltage-current characteristic of the EL element of the detection target pixel.

The method may include connecting, to the data signal line, a source electrode of a driving transistor of the detection target pixel and a source electrode of a driving transistor of each of remaining pixels in the same row as the detection target pixel, and connecting, to a power line, the source electrode of the driving transistor of each of the pixels in a different row from the detection target pixel.

Detecting the threshold voltage of the driving transistor or a voltage-current characteristic of the EL element in the detection target pixel may be performed when one or more of the other pixels emit light.

Correcting for the variation may include generating correction data of the threshold voltage of the driving transistor or correction data of the EL element from the detected data value.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
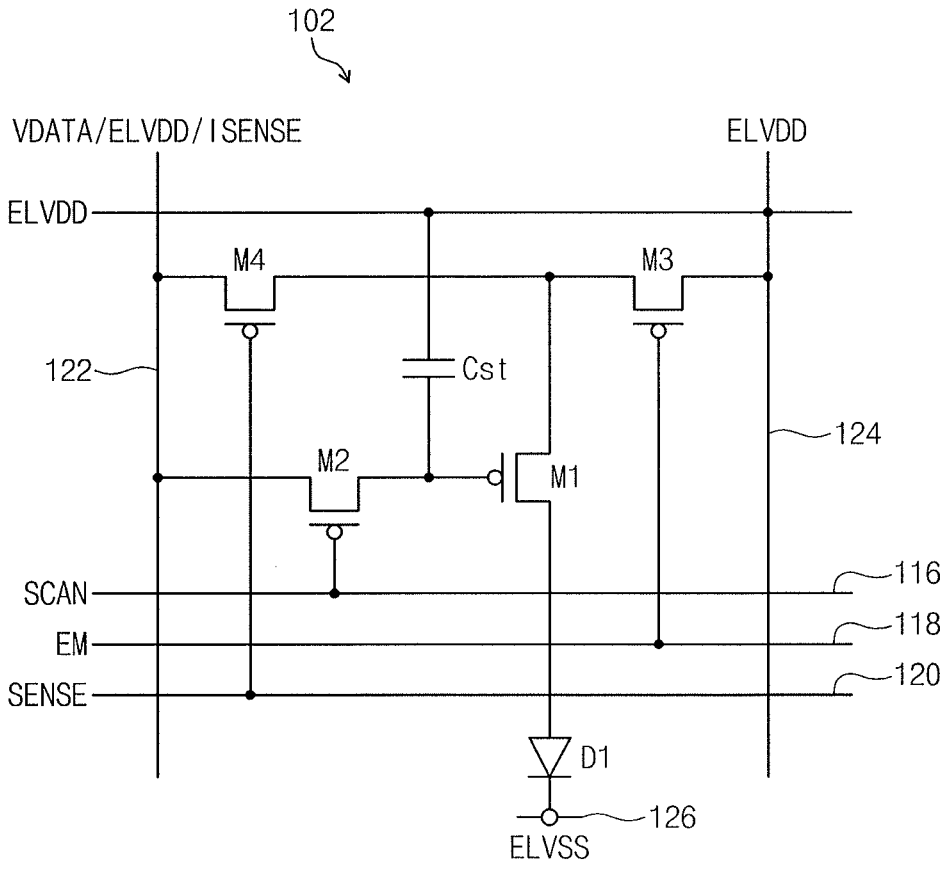
FIG. 1 illustrates a first embodiment of pixel circuit of an electro-optical device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 is a first embodiment of a pixel circuit 102 of an electro-optical device. The pixel circuit 102 is included in a panel with a plurality of other pixel circuits, which emit light for forming an image.

Referring to FIG. 1, pixel circuit 102 includes an organic EL element D1, a driving transistor M1, a selection transistor M2, switching transistors M3 and M4, and a storage capacitance Cst.

A drain electrode of driving transistor M1 is connected to an anode of the EL element D1. A potential of a gate electrode of driving transistor M1 is controlled by selection transistor M2 connected to data signal line 122. The storage capacitance Cst is connected between the gate electrode of driving transistor M1 and a power line 124 supplied with a high voltage power ELVDD. The storage capacitance Cst may charge a gate potential of driving transistor M1.

A gate electrode of selection transistor M2 is connected to a selection signal line 116. The selection transistor M2 provides the gate electrode of driving transistor M1 with a potential corresponding to a data signal from data signal line 122, in response to a selection signal provided via selection signal line 116. The switching transistor M3 is connected between the source electrode of driving transistor M1 and power line 124.

A gate electrode of switching transistor M3 is connected to an emission control line 118 for controlling emission timing of the EL element D1. Also, switching transistor M4 is connected between the source electrode of driving transistor M1 and data signal line 122. A gate electrode of switching transistor M4 is connected to selection signal line 120.

If a predetermined potential is provided to a gate electrode of driving transistor M1 and switching transistor M3 is turned on, an anode of the EL element D1 is electrically connected to power line 124 and its cathode is electrically connected to a power line 126, which is supplied with a low voltage power ELVSS. At this time, the EL element D1 emits light.

Figure 2:
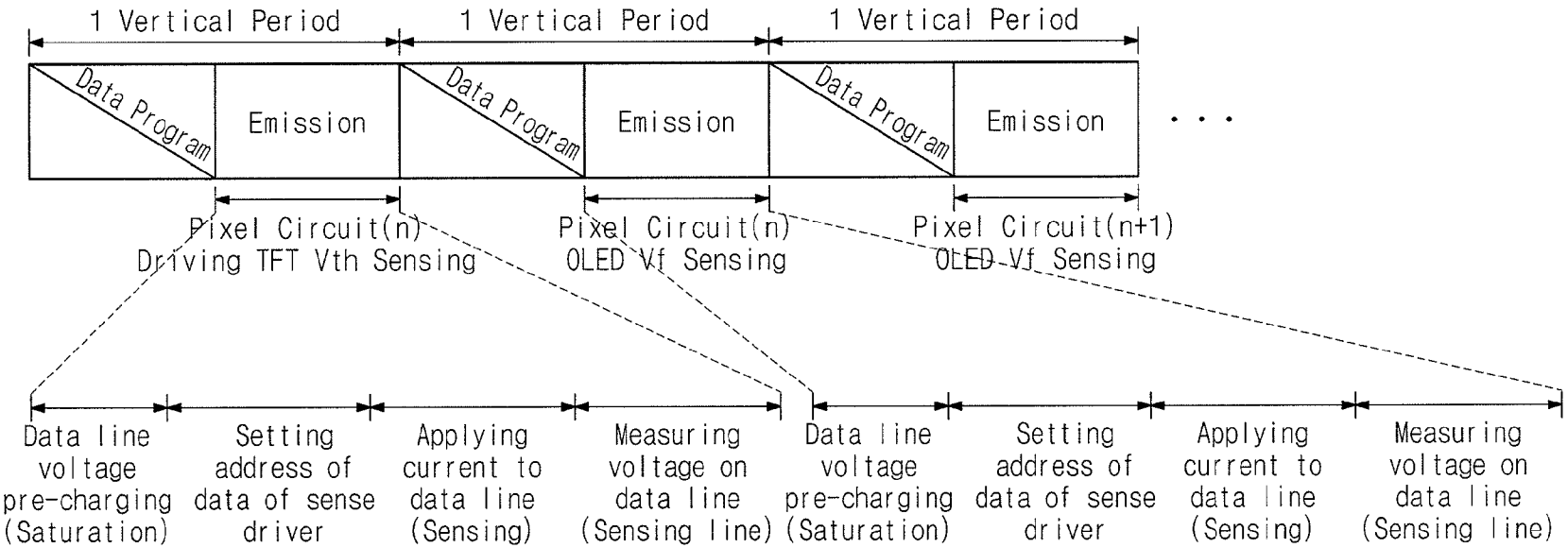
FIG. 2 illustrates a first embodiment of a method for driving an electro-optical device.

FIG. 2 illustrates a first embodiment of a method for driving an electro-optical device. Referring to FIG. 2, in a 1-frame period, all pixels are programmed with data and emit light at the same time. In an emission period, a pixel is selected to detect a threshold voltage of the driving transistor or to measure a voltage-current characteristic of the EL element.

For example, to detect the threshold voltage of the driving transistor of a specific pixel, during an emission period of 1-frame period, a data signal line is pre-charged, an address of a detection circuit is set as an address of the specific pixel of a measurement target, and a current is applied to a driving transistor of the specific pixel.

Also, to measure the voltage-current characteristic of the EL element of the specific pixel, during the emission period of the 1-frame period, the data signal line is pre-charged, an address of the detection circuit is set as an address of the specific pixel of the measurement target, and a current is applied to the EL element of the pixel.

Figure 3:
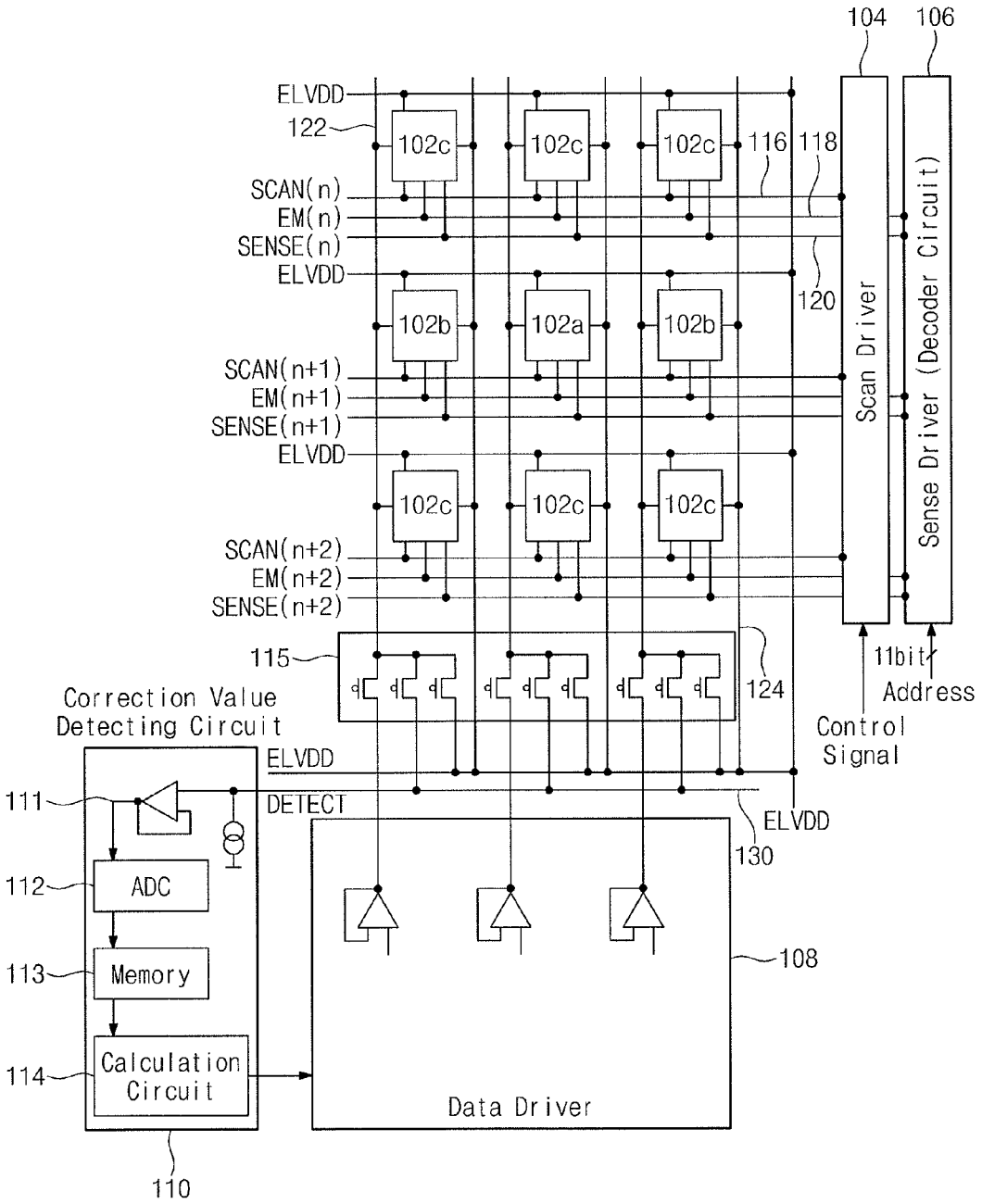
FIG. 3 illustrates a first embodiment of an electro-optical device.

FIG. 3 is a first embodiment of an electro-optical device, which includes a scan driver 104 that outputs a selection signal, via a selection signal line 116, in response to a control signal. A sense driver 106 outputs signals via a selection signal line 120 and an emission control line 118. A data driver 108 outputs a data signal corresponding to an image signal via a data signal line 122.

A correction value detecting circuit 110 is connected to a detection signal line 130. The correction value detecting circuit 110 provides data signal line 122 with a constant detection current when detection signal line 130 and data signal line 122 are connected by switch circuit 115.

The correction value detecting circuit 110 includes a sense circuit 11, an analog-to-digital (A/D) converting circuit 112, a memory 113, and a calculation unit 114. The sense circuit 111 measures a voltage value (a source voltage of a driving transistor) on a data line when the constant detection current is supplied to data signal line 122. The A/D converting circuit 112 performs analog-to-digital conversion for an output value of sense circuit 111. The memory 113 stores data after the analog-to-digital conversion. The calculation circuit 114 calculates a correction value using data from memory 113. An output value of calculation circuit 114 is provided as a correction value to data driver 108.

Data signals VDATA are provided from data driver 108 to respective data signal lines 122. A detection current ISENSE is provided from correction value detecting circuit 110 to data signal line 122. Also, a power supply voltage ELVDD is provided to pixel circuit 102, which belongs to the same row as a pixel of a detection target, for controlling EL element to emit light. Power supply voltage ELVDD may be provided on data signal line 122.

Given the above structure, signals with different voltages (or currents) are provided to data signal line 122 based on predetermined timings. To achieve this, switch circuit 115 selectively outputs a signal with different voltages according to predetermined timing.

Figure 4:
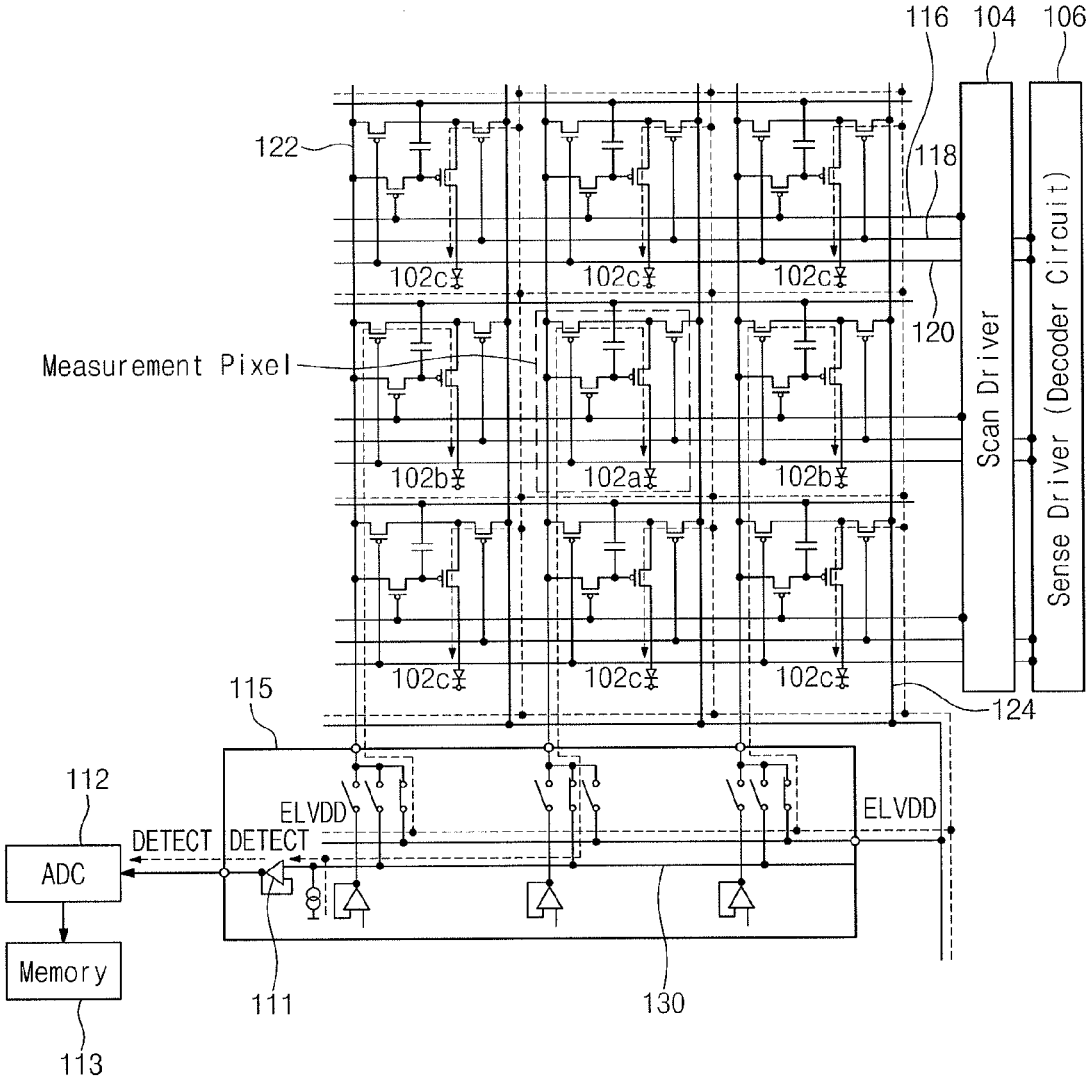
FIG. 4 illustrates a panel state diagram according to the first embodiment.

FIG. 4 illustrates a first embodiment of a panel state diagram upon sensing of a panel of an electro-optical device. An operation of sensing a specific pixel corresponding to a measurement target is described with reference to FIG. 4.

In FIG. 4, a pixel 102*a* may be a detection target pixel. Pixels connected to the same emission control line 118 as pixel 102s are labeled by reference numeral 102*b* and remaining pixels are labeled by reference numeral 102*c*.

Pixel 102*c* is a pixel that operates in a typical manner. In an emission period, an organic EL element D1 is connected to power line 124 via a driving transistor M1 and a switching transistor M3. As a result, organic EL element D1 of pixel circuit 102*c* emits light based on a drain current of driving transistor M1.

Because switching transistor M3 is turned off, pixel 102*b* is disconnected from power line 124. However, because switching transistor M4 is turned on, pixel 102*b* is supplied with a power supply voltage ELVDD from data signal line 122. Thus, the organic EL element D1 of pixel 102*b* emits light based on a drain current of driving transistor M1.

A switch circuit 115 includes a switching transistor for connecting a detection signal line 130 and power line 124. The switch circuit 115 operates such that power line 124 is connected to remaining data signal lines 122, other than a data signal line 122 corresponding to a column where detection target pixel 102*a* is located.

The data signal line 122 of detection target pixel 102*a* is connected to a correction value detecting circuit 110 through a switching transistor of switch circuit 115. As a switching transistor M4 of pixel 102*a* is turned on, a detection current is supplied to driving transistor M1 via a detection signal line 130 connected to correction value detecting circuit 110. At this time, a sense circuit 111 may detect a voltage of a source electrode of driving transistor M1.

Figure 5A:
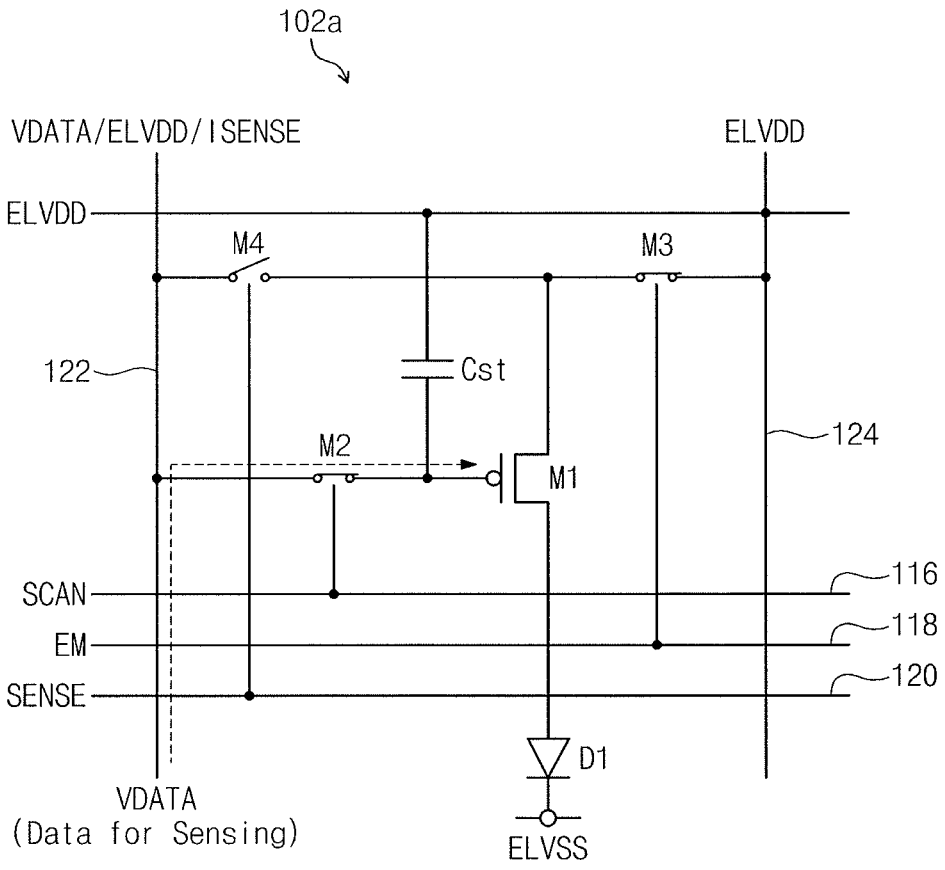
FIGS. 5A-5F illustrate operation of a first embodiment of a pixel.
Figure 5B:
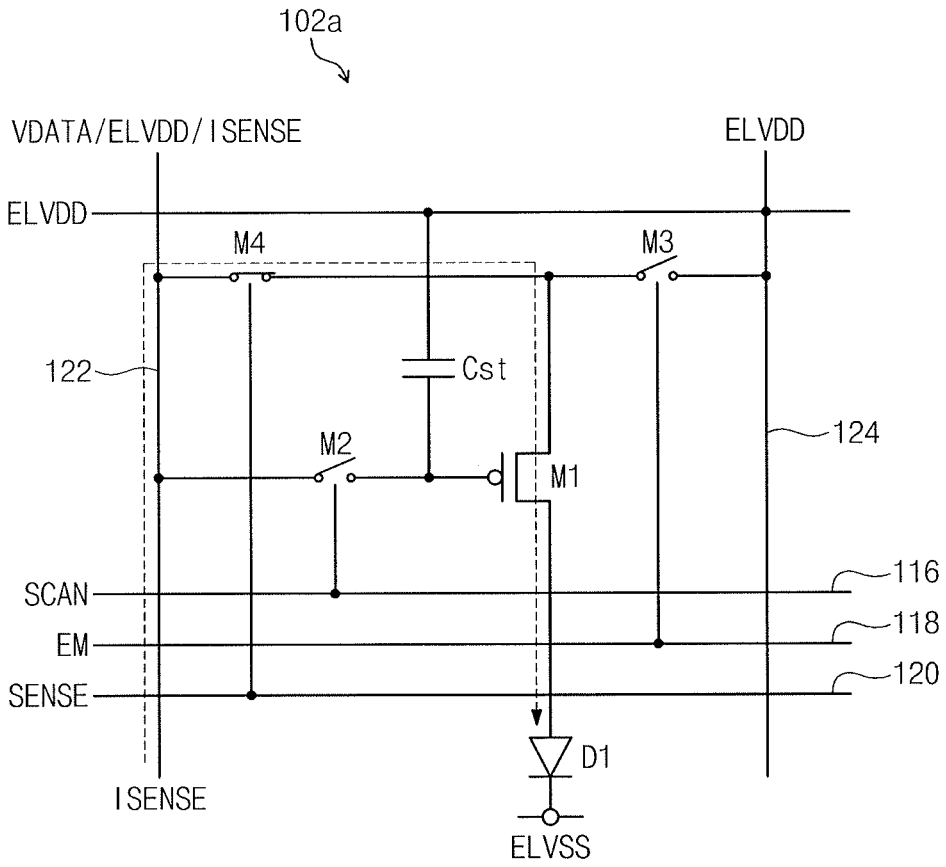
Figure 5C:
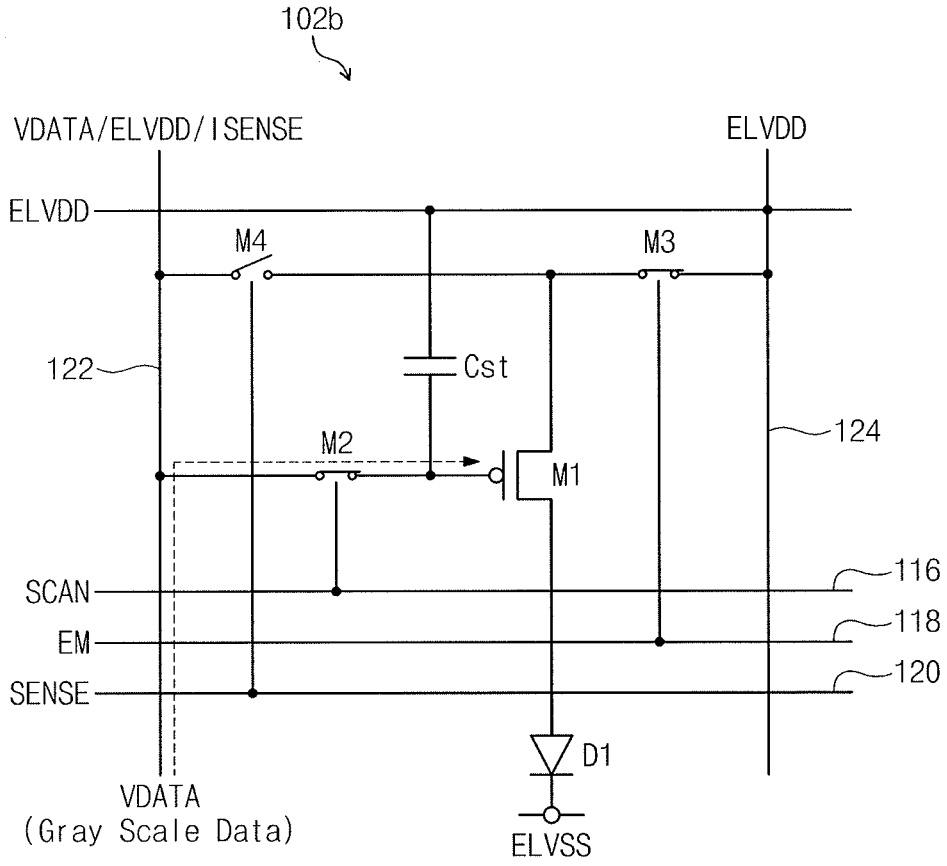
Figure 5D:
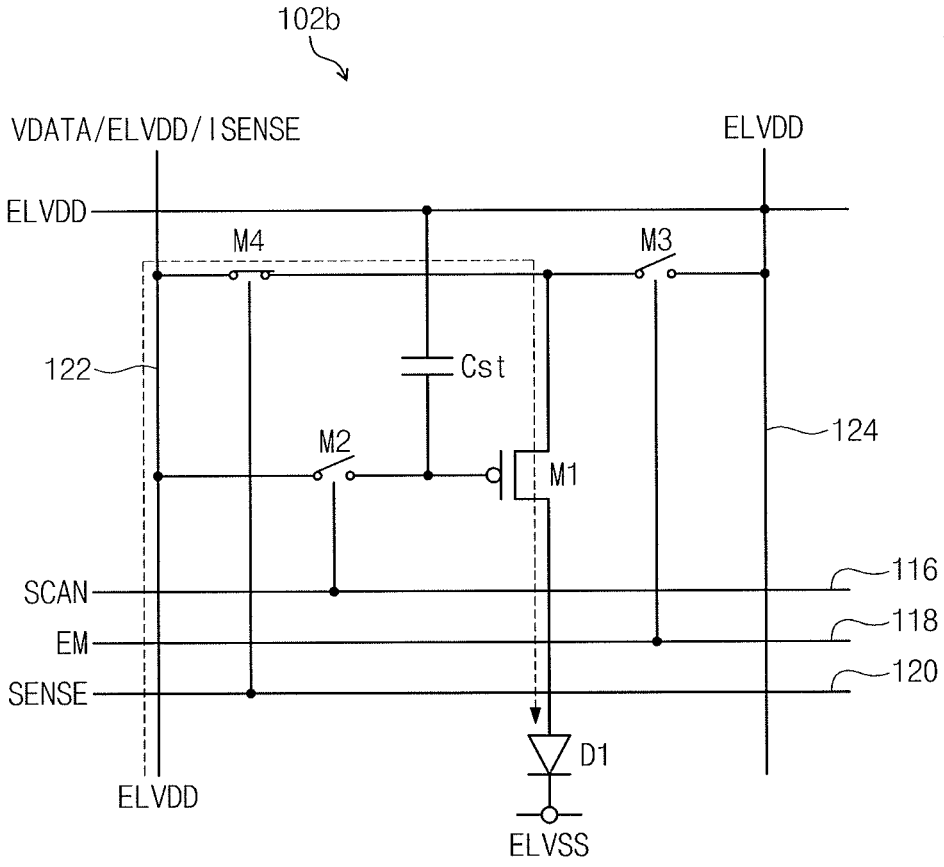
Figure 5E:
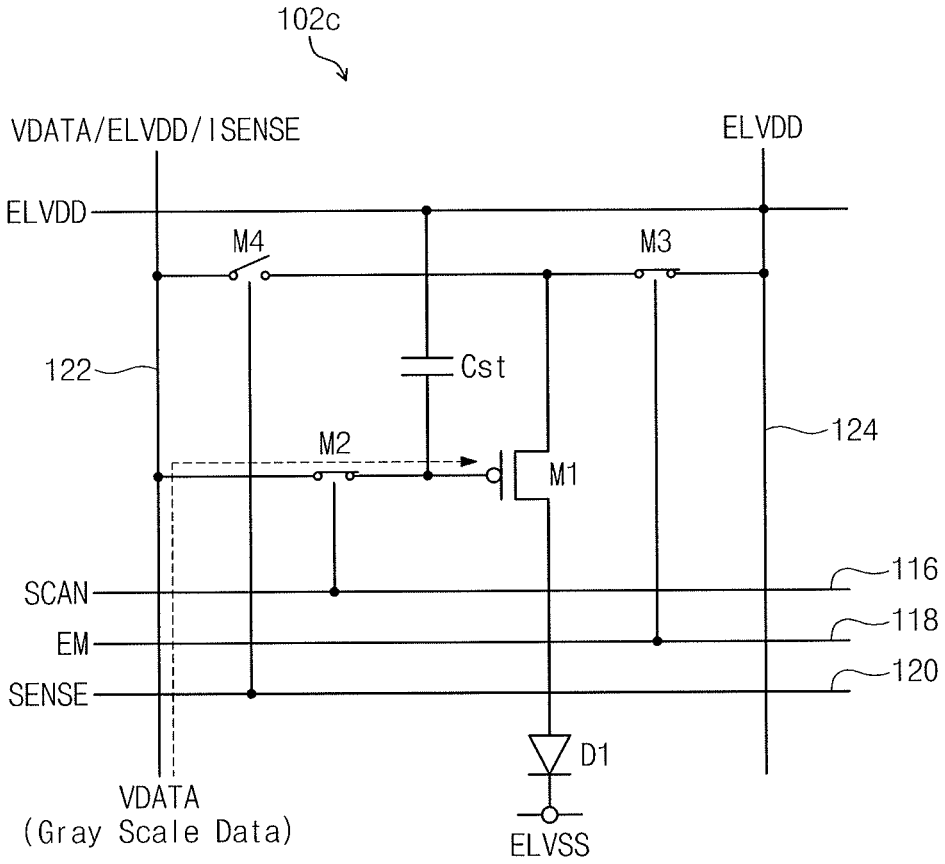
Figure 5F:
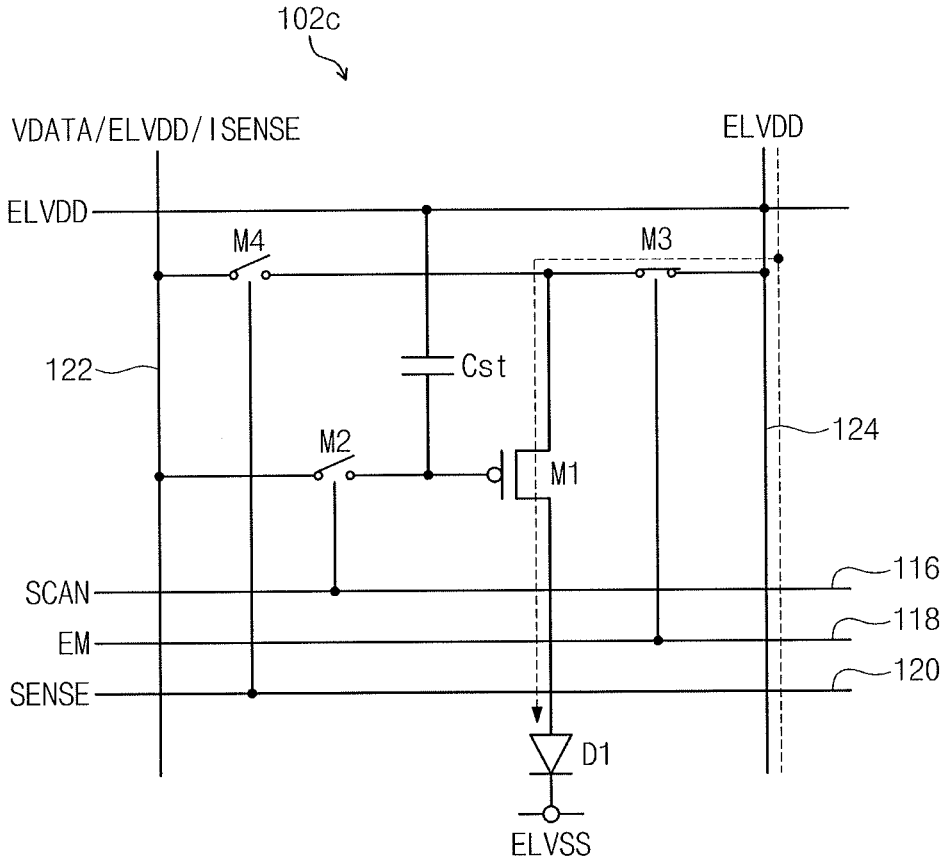

FIGS. 5A to 5F illustrate operation of pixel circuits 102*a*, 102*b*, and 102*c* for a detection operation of an electro-optical device. More specifically, FIGS. 5A and 5B illustrate operation of pixel 102*a*, FIGS. 5C and 5D illustrate operation of pixel 102*b*, and FIGS. 5E and 5F illustrate operation of the pixel 102*c*.

Referring to FIG. 5A, when data is written at detection target pixel 102*a*, data for detection is written at a gate electrode of a driving transistor M1 through a selection transistor M2 that is turned on.

Referring to FIG. 5B, after selection transistor M2 is turned off, a detection current ISENSE is provided to data signal line 122. At this time, switching transistor M4 is turned on. A correction value detecting circuit 110 measures a voltage value (or, source voltage of the driving transistor) on a data signal line. The voltage value is measured to provide an indication of a threshold voltage of driving transistor M1 or a voltage-current characteristic of organic EL element D1.

Referring to FIG. 5C, when data is written at pixel 102*b* connected to the same selection signal line 120 as detection target pixel 102*a*, data voltage VDATA is written at a gate electrode of driving transistor M1 through selection transistor M2, that is turned on.

Referring to FIG. 5D, as the switching transistor M4 is turned on by a selection signal line 120, driving transistor M1 is connected to data signal line 122 onto which a power supply voltage ELVDD is supplied. Thus, the organic EL element D1 emits light based on a drain current of the driving transistor M1.

Referring to FIG. 5E, when data is written at pixel 102*c*, data voltage VDATA is written at a gate electrode of driving transistor M1 through selection transistor M2, that is turned on.

Referring to FIG. 5F, as switching transistor M3 is turned on, driving transistor M1 is connected to power line 124. Thus, the organic EL element D1 emits light based on a drain current of the driving transistor M1.

Figure 6A:
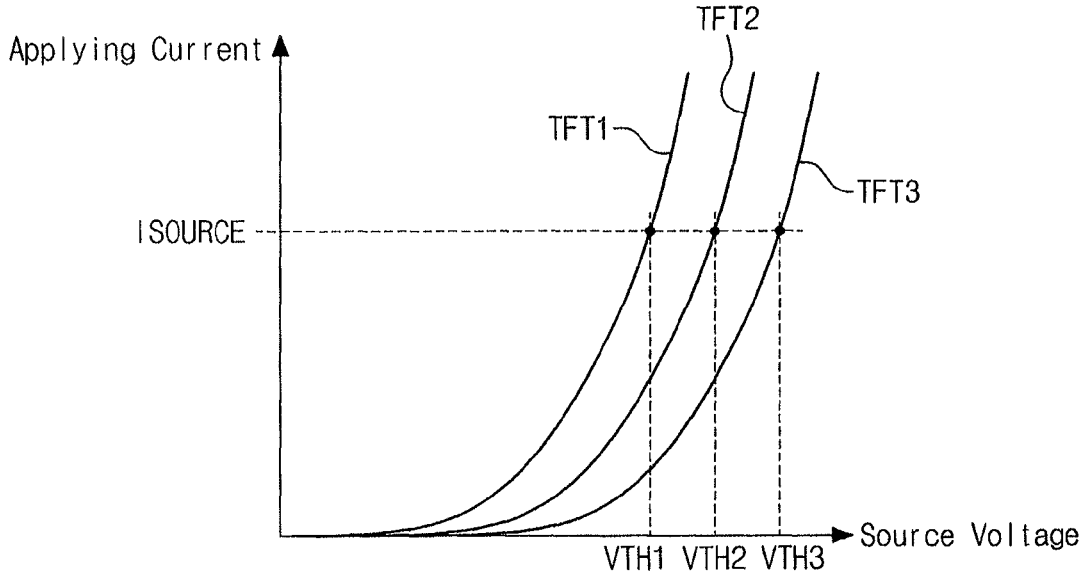
FIGS. 6A and 6B illustrate a variation in source voltage of a driving transistor.
Figure 6B:
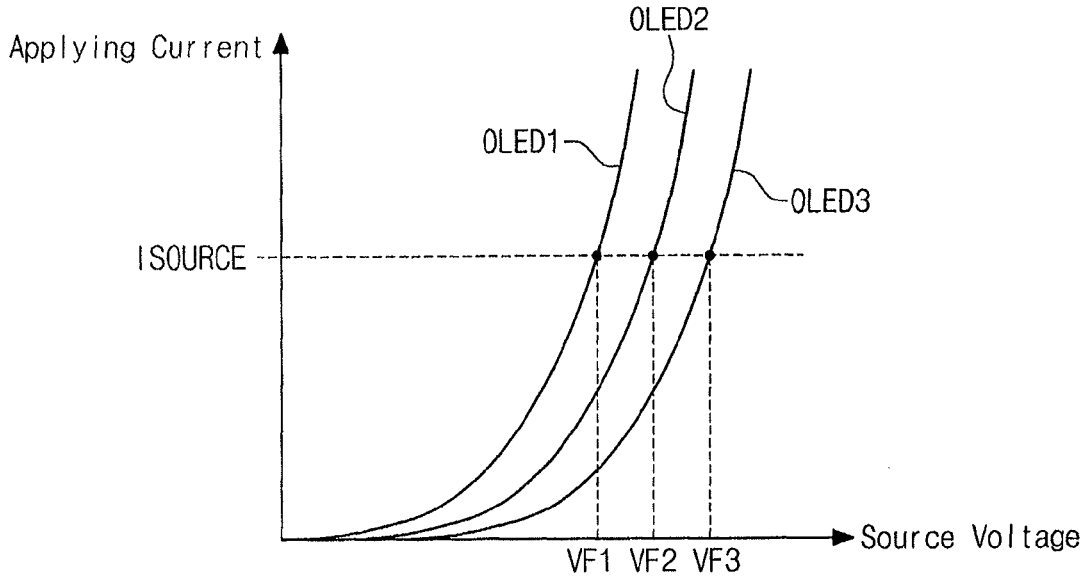

FIGS. 6A and 6B illustrate examples of a variation in the source voltage of a driving transistor upon sensing.

Referring to FIG. 6A, to detect the threshold voltage of a driving transistor, a voltage for detection is provided to a gate electrode of driving transistor to cause the driving transistor to operate in the saturation region. As illustrated in FIG. 6A, if a constant source current is provided when the driving transistor operates in the saturation region, a source voltage of the driving transistor varies due to the threshold voltage of the driving transistor. Thus, the threshold voltage of the driving transistor may be detected by detecting a voltage value of the driving transistor.

Referring to FIG. 6B, to obtain a voltage-current characteristic of the organic EL element, a voltage for detection is provided to the gate electrode of the driving transistor to cause the driving transistor to operate in the linear region. As illustrated in FIG. 6B, if a constant source current is provided when the driving transistor operates in the linear region, a source voltage of the driving transistor varies due to an operating voltage of the organic EL element. Thus, a degree of deterioration of the organic EL element may be measured by detecting a voltage value of the organic EL element.

With this circuit configuration, a detection target pixel does not perform an emission operation corresponding to a data signal. other pixels may perform a typical emission operation, even though they are arranged in the same row as the detection target pixel.

Thus, according to one embodiment, an electro-optical device selects only a specific pixel as a detection target to measure a threshold voltage of a driving transistor or a voltage-current characteristic of an organic EL element in a display device. In this case, other pixels may emit light under a control of the electro-optical device. With this operation, when an image is displayed, a line defect does not occur and correction data of the specific pixel may be obtained.

Also, in one embodiment, a plurality of correction value detecting circuits may be included. In this case, detection operations for pixels belonging to another row, among pixels arranged in a matrix shape, may be performed at the same time.

If a pixel disposed at any row where a detection operation is performed does not perform a typical emission operation upon the detection operation, a viewer may see a line defect. However, although the electro-optical device according to the first embodiment displays an image using a plurality of pixels, a pixel where the detection operation is performed may not be seen by a user. This is because some pixels may perform a detection operation discretely.

Thus, an electro-optical device according to the first embodiment obtains correction data by individually selecting a detection target pixel. An image is then displayed through typical light emitting operations of other pixels. Because a line defect does not occur, a correction operation may be executed without a decrease in display quality.

Figure 7:
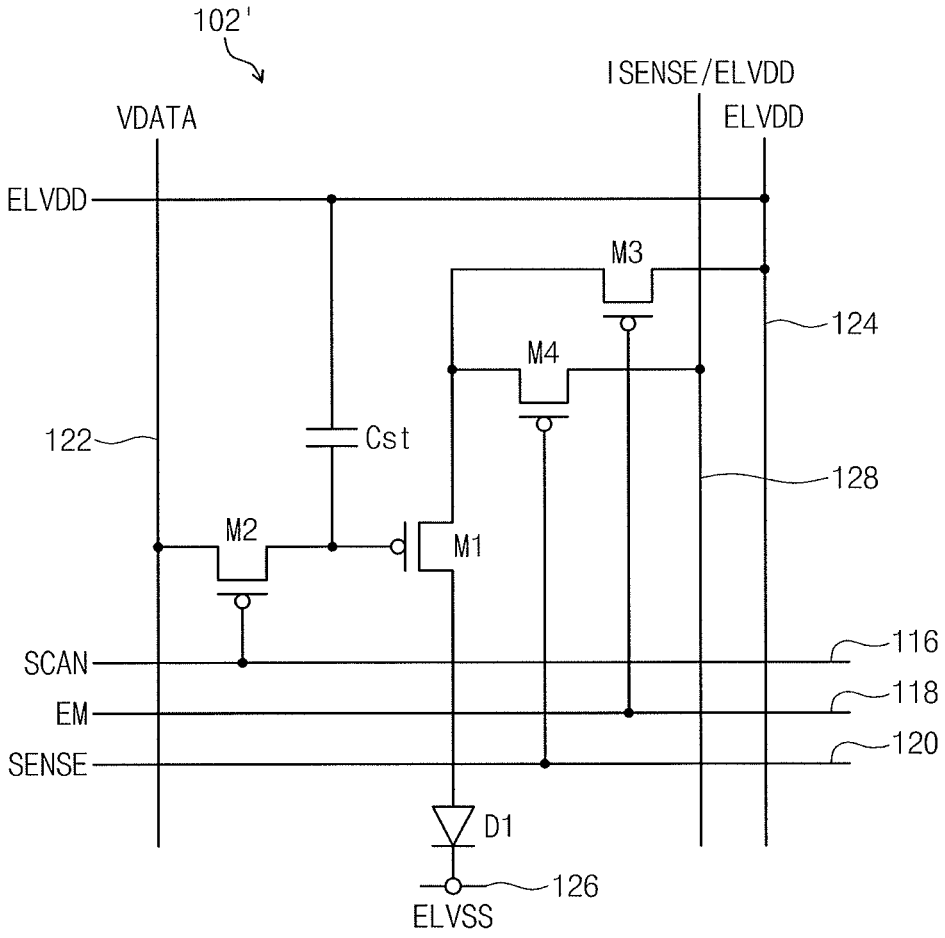
FIG. 7 illustrates a second embodiment of a pixel circuit.

FIG. 7 illustrates a second embodiment of a pixel circuit in an electro-optical device. Referring to FIG. 7, like the pixel circuit in FIG. 1, pixel circuit 102' according to the second embodiment includes an organic EL element D1, four transistors M1 to M4, and one capacitive element Cst.

Unlike the pixel circuit in FIG. 1, the pixel circuit 102 shown in FIG. 7 provides a current ISENSE for detection to be provided to a detection target pixel and a power supply voltage ELVDD to an additional sense signal line 128, not a data signal line 122.

A drain electrode of driving transistor M1 is connected to the anode of the organic EL element D1. A source electrode thereof is connected to power line 124 via switching transistor M3. A source electrode of driving transistor M1 is connected to switching transistor M4.

The switching transistor M4 is connected to a selection signal line 120 that selects connection between the sense signal line 128 and the source electrode of the driving transistor M1. The sense signal line 128 is supplied with current ISENSE for detection and power supply voltage ELVDD. Emission timing of the EL element D1 is controlled by switching transistor M3, which has a gate electrode connected to emission control line 118.

Figure 8:
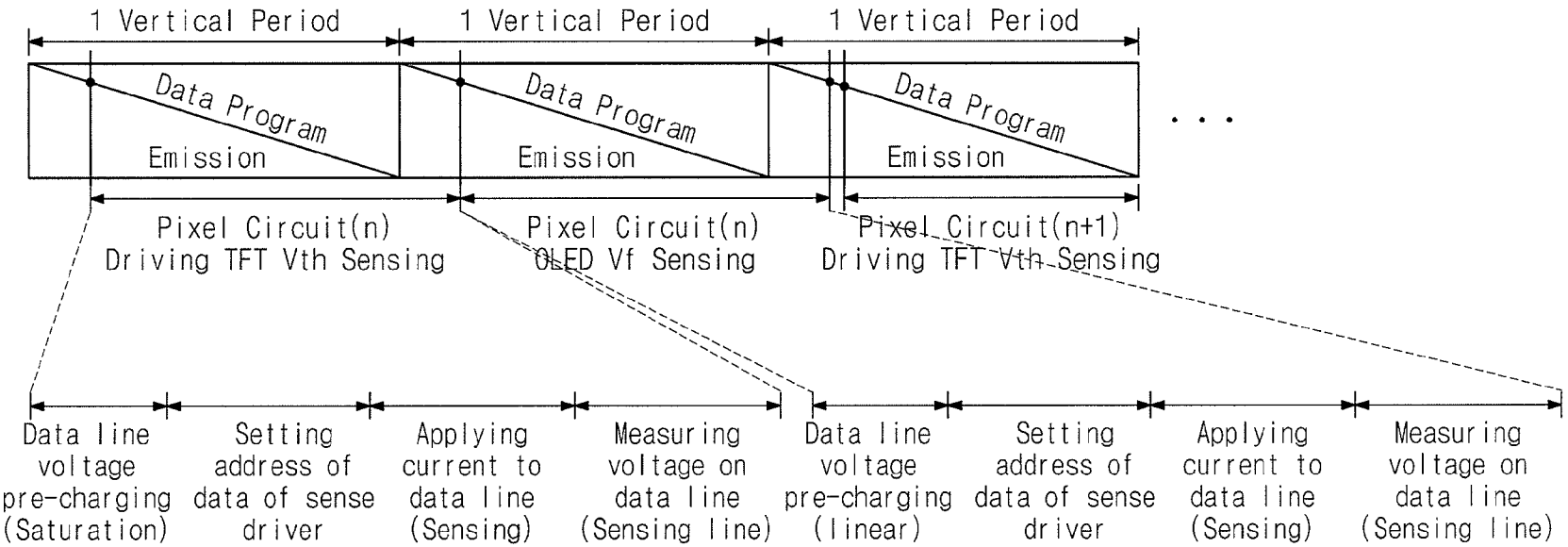
FIG. 8 illustrates a second embodiment of a method for driving an electro-optical device.

FIG. 8 illustrates a second embodiment of a method for driving an electro-optical device. Referring to FIG. 8, in a 1-frame period, data programming and pixel emission are progressively performed. Thus, the present embodiment of the driving method may be referred to as a progressive driving method.

In this method, to detect a threshold voltage of a driving transistor of a specific pixel, during an emission period of the 1-frame period, an address of a detection circuit is set as an address of the specific pixel of a measurement target. Also, current is applied to the driving transistor of the specific pixel.

This operation may be performed up to a period where data is written at the pixel in a next 1-frame period. Also, to measure a voltage-current characteristic of an organic EL element, during an emission period of the next 1-frame period, an address of the detection circuit is set as an address of the specific pixel of the measurement target. Also, current is applied to the organic EL element of the specific pixel.

A threshold voltage of the driving transistor and voltage-current characteristic of the organic EL element may be measured in successive frame periods. Alternatively, a threshold voltage of the driving transistor and voltage-current characteristic of the organic EL element may be measured in a first period and in a second frame period that is temporarily apart from the first frame period.

Figure 9:
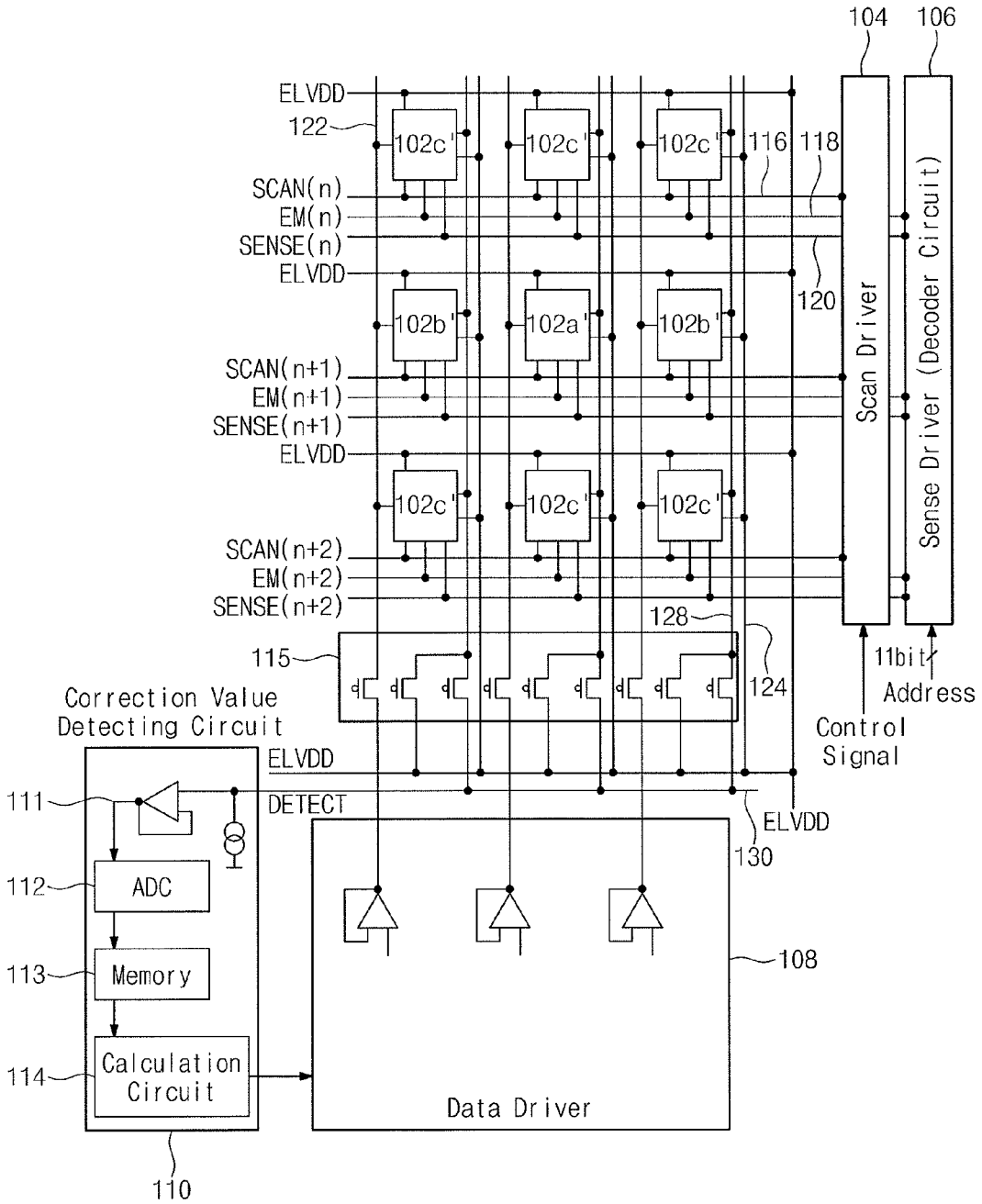
FIG. 9 illustrates a panel configuration diagram according to a second embodiment.

FIG. 9 illustrates a panel configuration diagram of an electro-optical device according to a second embodiment. In FIG. 9, a scan driver 104, sense driver 106, data driver 108, and correction value detecting circuit 110 are configured substantially the same as scan driver 104, sense driver 106, data driver 108, and correction value detecting circuit 110 in FIG. 3.

Unlike FIG. 3, a sense signal line 128 further included. Due to sense signal line 128, a connection of transistors of switch circuit 115 may be different from that of FIG. 3. For example, switching transistors may be disposed such that the sense signal line 128 of switch circuit 115 is connected to correction value detecting circuit 110 or power line 124.

Figure 10:
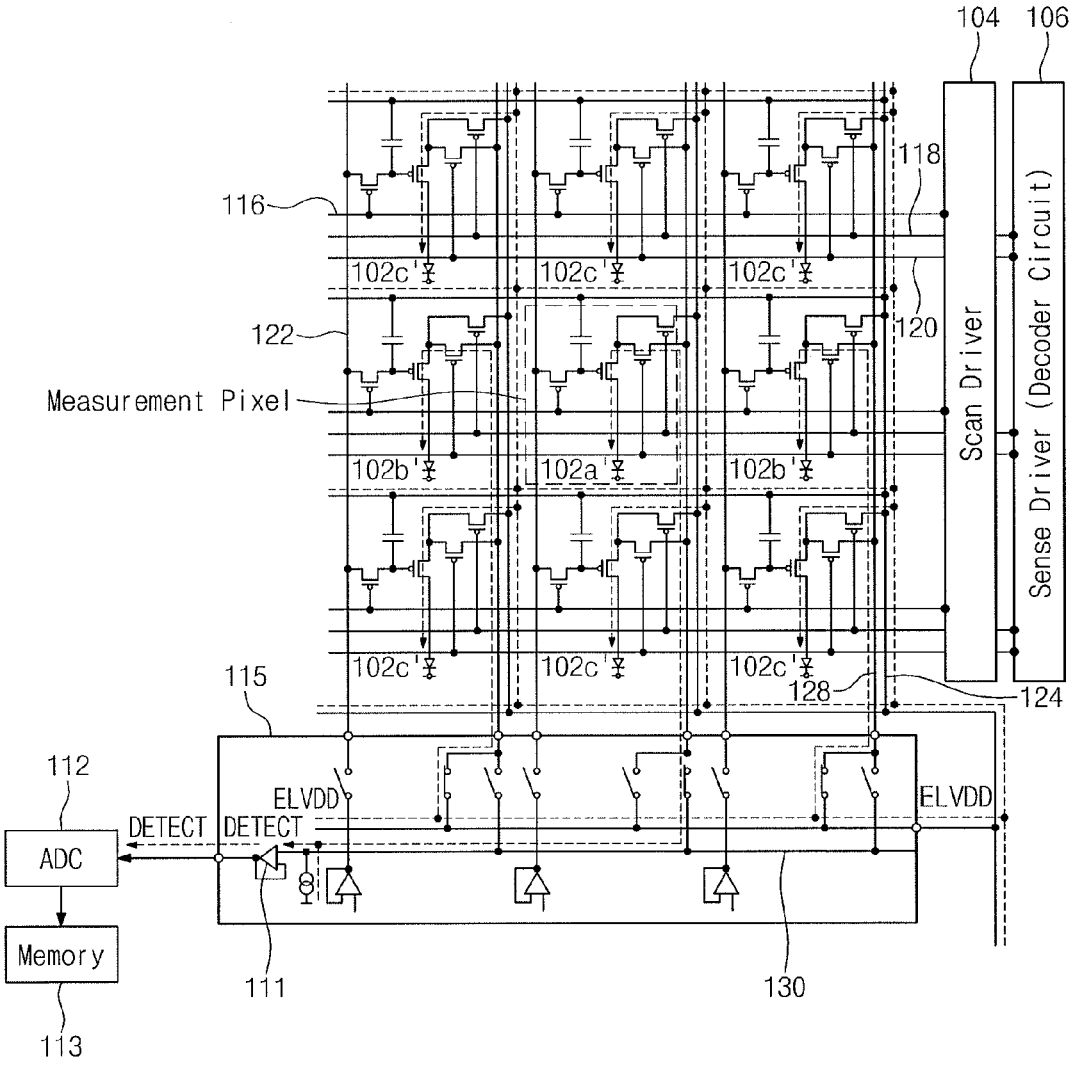
FIG. 10 illustrates a panel state diagram according to a second embodiment.

FIG. 10 illustrates a second embodiment of a panel state diagram for performing a sensing operation of a specific pixel for a measurement target. In FIG. 10, a pixel circuit 102*a*' may be a detection target pixel. Pixels connected to the same emission control line 118 as pixel 102*a*' are labeled by reference numeral 102*b*' and remaining pixels are labeled by reference numeral 102*c*'.

Pixel 102*c*' is a pixel that operates in a typical manner. In an emission period, an organic EL element D1 of pixel 102*c*' is connected to power line 124 via a driving transistor M1 and a switching transistor M3, so the organic EL element D1 emits light based on a drain current of the driving transistor M1.

Because switching transistor M3 is turned off, the organic EL element D1 of pixel 102*b*' is disconnected from power line 124. However, because switching transistor M4 is turned on, the organic EL element D1 of the pixel 102*b*' is connected to sense signal line 128, which is supplied with power supply voltage ELVDD. Thus, the organic EL element D1 of pixel 102*b*' emits light based on a drain current of driving transistor M1.

The sense signal line 128 of detection target pixel 102*a*' is connected to a detection signal line 130 via a switching transistor of switch circuit 115. The detection signal line 130 is connected to correction value detecting circuit 110. Because switching transistor M4 of pixel 102*a*' is turned on, a detection current on sense signal line 128 is transferred to driving transistor M1. At this time, correction value detecting circuit 110 detects a source voltage of driving transistor M1.

Figure 11A:
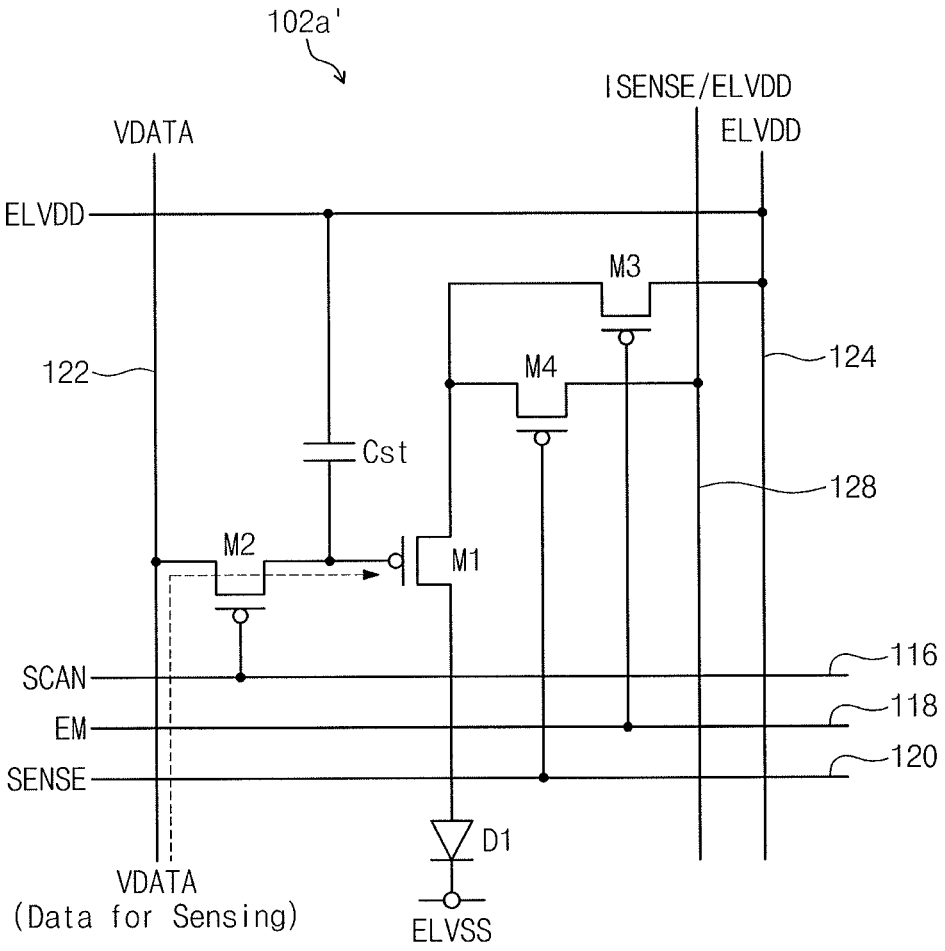
FIGS. 11A-11F illustrate operation of a second embodiment of a pixel.
Figure 11B:
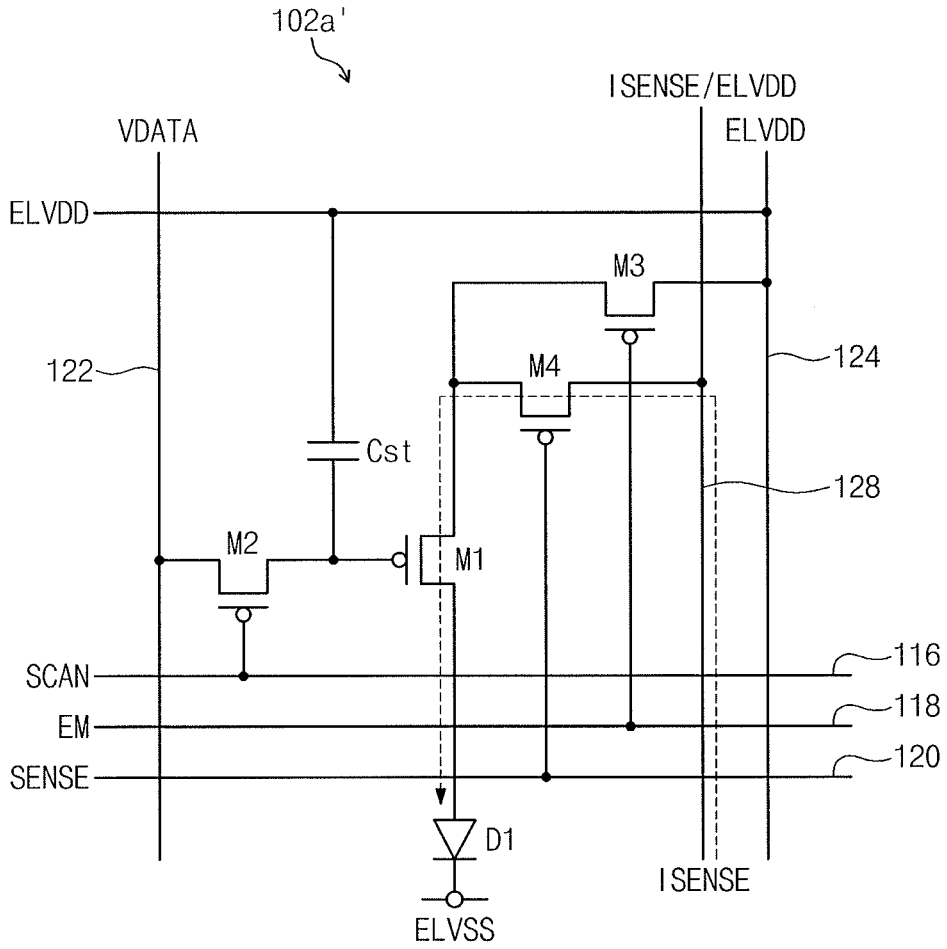
Figure 11C:
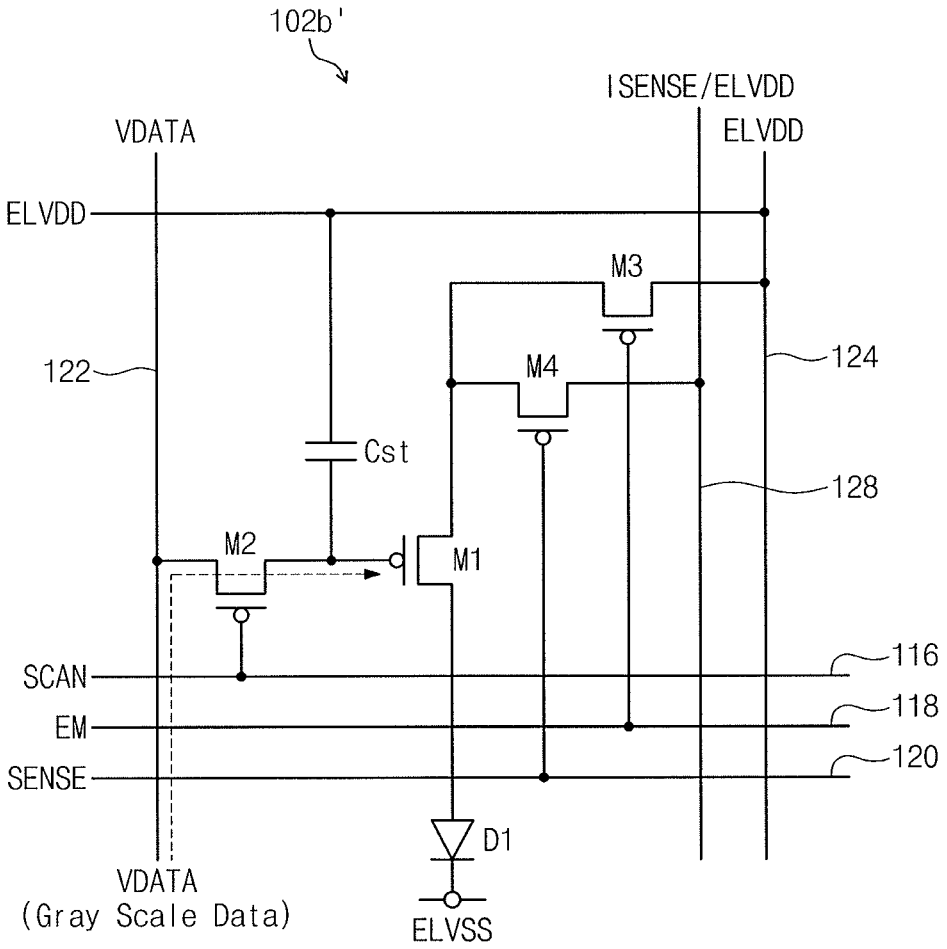
Figure 11D:
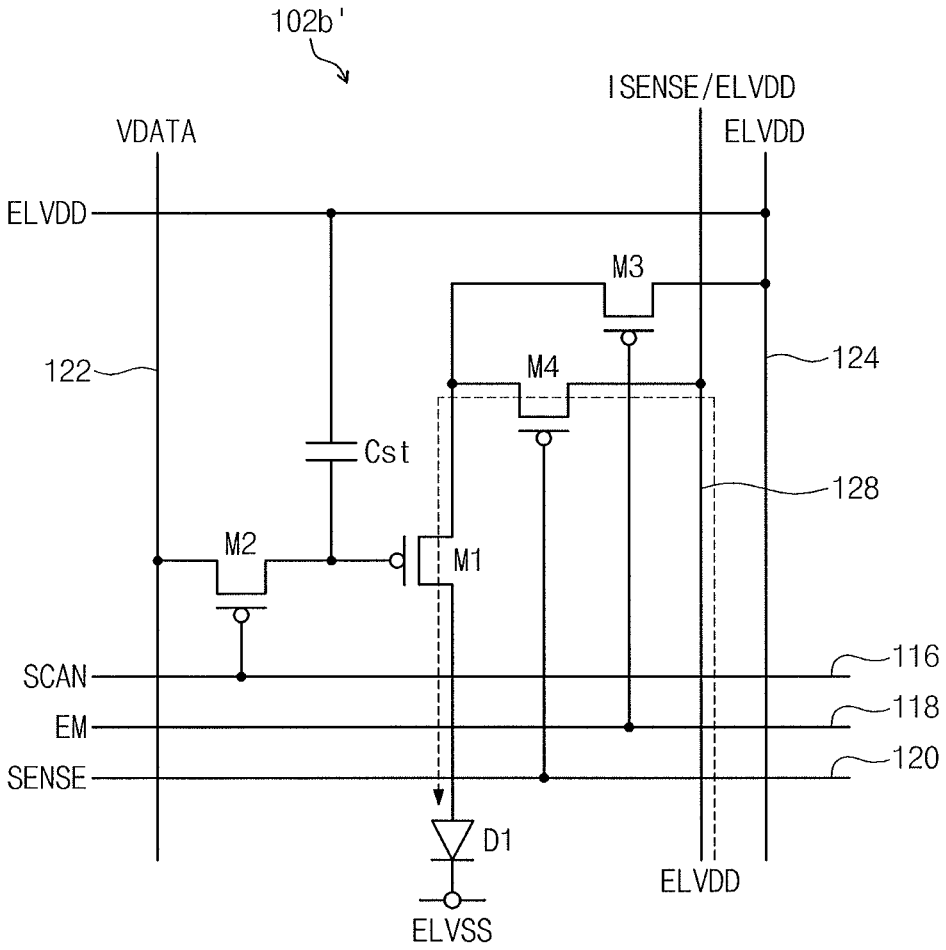
Figure 11E:
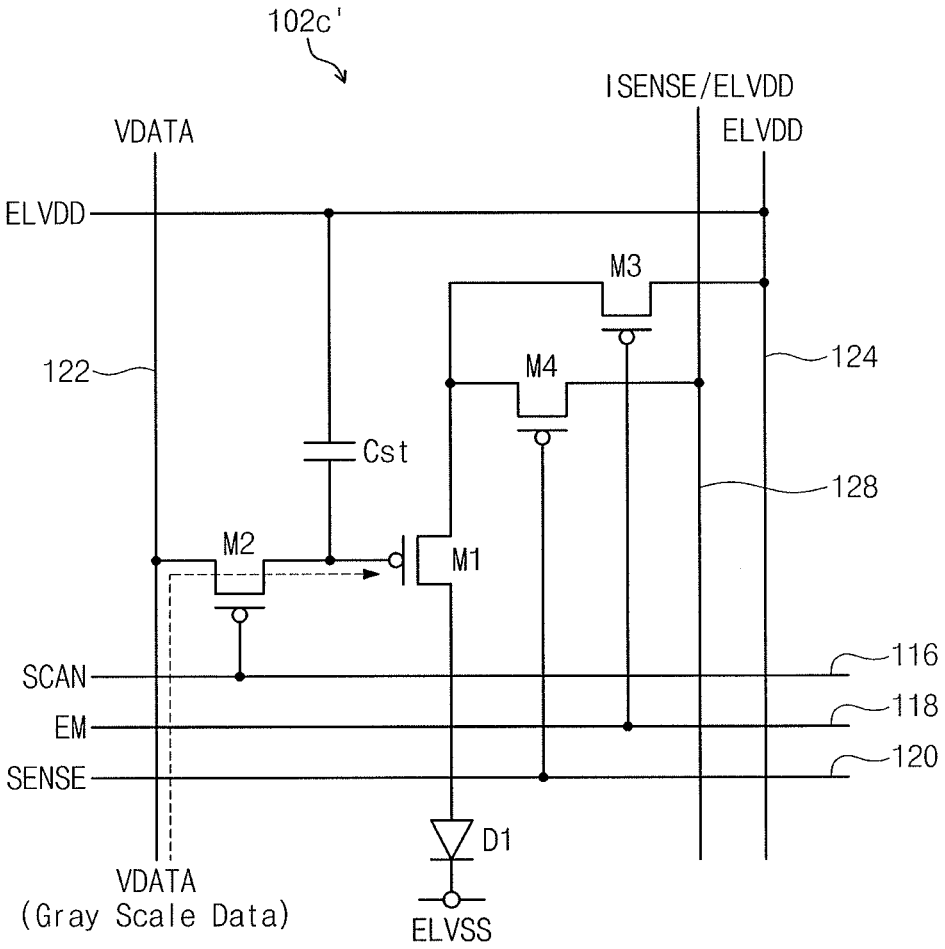
Figure 11F:
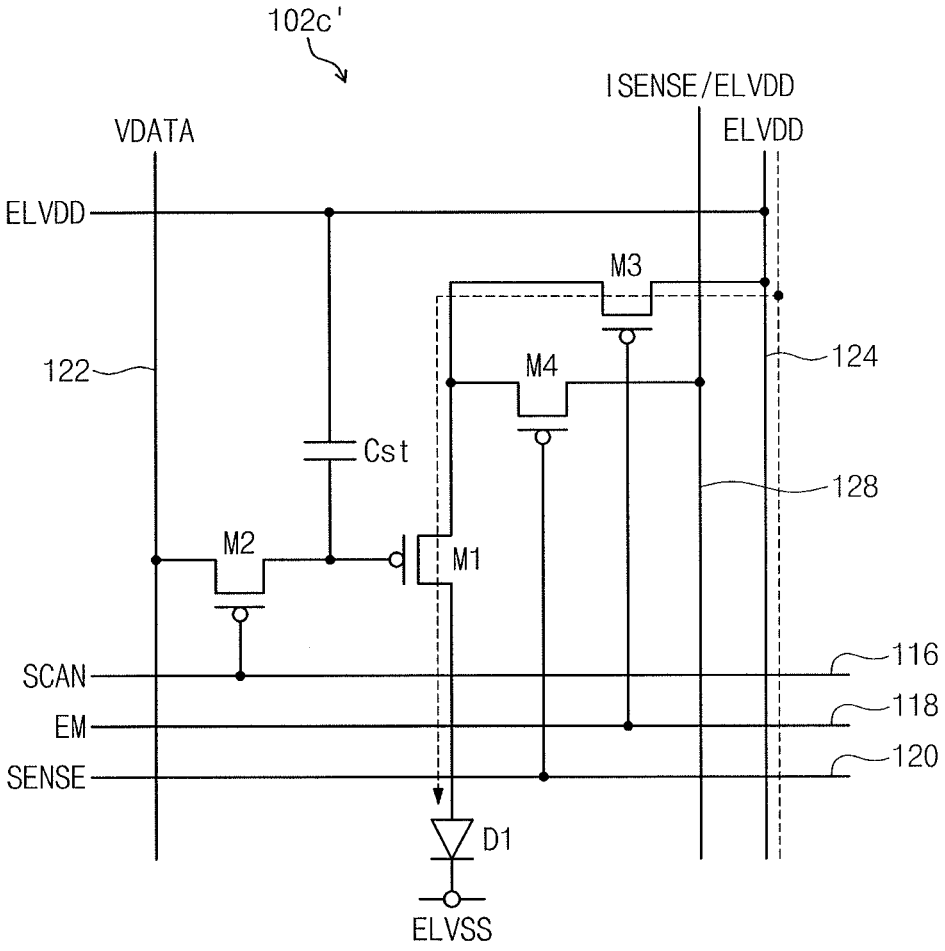

FIGS. 11A to 11F illustrate operation of a second embodiment of pixel circuits 102*a*', 102*b*', and 102*c*' for a detection operation of an electro-optical device. FIGS. 11A and 11B illustrate operation of the pixel 102*a*', FIGS. 11C and 11D illustrate operation of pixel 102*b*', and FIGS. 11E and 11F illustrate operation of pixel 102*c*'.

Referring to FIG. 11A, when data is written at a detection target pixel 102*a*', detection data is written at a gate electrode of a driving transistor M1 through a selection transistor M2 that is turned on.

Referring to FIG. 11B, after selection transistor M2 is turned off, a detection current ISENSE is provided to sense signal line 128 and switching transistor M4 is turned on. At this time, correction value detecting circuit 110 measures a voltage value (or, a source voltage of a driving transistor) on a data signal line to measure a threshold voltage of driving transistor M1 or voltage-current characteristic of EL element D1.

Referring to FIG. 11C, when data is written at the pixel 102*b*' connected to the same selection signal line 120 as detection target pixel 102*a*', a data voltage VDATA is written at a gate electrode of driving transistor M1 through selection transistor M2 that is turned on.

Referring to FIG. 11D, as switching transistor M4 is turned on by selection signal line 120, the driving transistor M1 is connected to sense signal line 128 onto which a power supply voltage ELVDD is supplied. Thus, the organic EL element D1 emits light based on a drain current of the driving transistor M1.

Referring to FIG. 11E, when data is written at the pixel 102*c*', the data voltage VDATA is written at a gate electrode of driving transistor M1 through selection transistor M2 that is turned on.

Referring to FIG. 11F, as switching transistor M3 is turned on, driving transistor M1 is connected to power line 124. Thus, the organic EL element D1 emits light based on a drain current of driving transistor M1.

In the second embodiment, because a data signal line and a sense signal line are separated, a measurement operation is performed even at a data program operation. Also, a measurement operation may be performed within a 1-frame period without limit. That is, in the first embodiment, a measurement operation is performed only within an emission period. In contrast, in the second embodiment, a measurement operation is performed over a period, thereby reducing a time taken to measure all pixels. Also, like the first embodiment, the second embodiment performs a correction operation without a decrease in display quality.

By way of summation and review, a variety of techniques have been developed in an attempt to suppress display quality degradation. One technique involves measuring the threshold voltage of a driving transistor and a voltage-current characteristic of an organic EL element by providing current to the source electrode of a driving transistor. The voltage of the source electrode is then measured. Addition of a correction value to gray scale data and correction of brightness may then be performed based on the measurement result.

When measuring the source electrode voltage, the gate electrode of the driving transistor is set to a voltage that causes the driving transistor to operate in the linear region. A voltage-current characteristic of the organic EL element is then measured. Also, the voltage of the gate electrode of the driving transistor may be set to cause the driving transistor to operate in the saturation region. A threshold voltage of the driving transistor may then be measured. Current flowing into the organic EL element or brightness of the organic EL element may be corrected by measuring the voltage-current characteristic of the EL element and threshold voltage of the driving transistor.

However, in this measurement method, a displayed image may include a line defect visible to a viewer. This is because selection of an entire line (e.g., row or horizontal line) is performed for obtaining a measurement when an image is displayed. When a voltage of the source electrode is measured, by providing current to a source electrode of a driving transistor, a time when the line defect occurs increases as a result of the time required to measure the source electrode voltage. This increase in time when the line defect occurs may decrease of the display quality.

In accordance with one or more of the aforementioned embodiments, a detection target pixel is independently selected from other pixels in a line. Measurement data is then obtained to perform a correction operation. As a result, a line defect will not occur, and correction can be performed without a decrease in display quality.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A panel, comprising a plurality of pixels arranged in a row direction and column direction, a correction value detecting circuit configured to provide a detection current to a detection signal line; and a switch circuit including a switching transistor for connecting the detection signal line to a data signal line, each of the pixels including:

a driving transistor having a drain electrode connected to an anode of an organic electroluminescence (EL) element, a selection transistor to control connection between a gate electrode of the driving transistor and the data signal line, a first switching transistor to control connection between a source electrode of the driving transistor and a power line for supplying current to the EL element, and a second switching transistor to control connection between the source electrode of the driving transistor and the data signal line, wherein:

during a data programming period, the selection transistor is turned on and a data voltage is provided from the data signal line to the gate electrode of the driving transistor, during an emission period, the source electrode of the driving transistor of a detection target pixel is connected to the data signal line by turning off the first switching transistor, and turning on the second switching transistor of the detection target pixel, and turning on the switching transistor of the switch circuit, so that the detection current is provided to the driving transistor from the data signal line, in each of the pixels in a same row as the detection target pixel, the source electrode of the driving transistor is connected to the data signal line by turning off the first switching transistor and turning on the second switching transistor, so that a same power supply voltage on the power line is provided to the driving transistor from the data signal line, and in each of the pixels in a row different from the detection target pixel, the source electrode of the driving transistor is connected to the power line by turning on the first switching transistor and turning off the second switching transistor, so that the EL element emits light.

2. An electro-optical device, comprising:

a panel including a plurality of pixels arranged in a row direction and a column direction, each of the pixels including a driving transistor having a drain electrode connected to an anode of an organic electroluminescence (EL) element, each pixel arranged in the column direction connected to a data signal line and a power line extending in the column direction;

a data driver to output a data signal to the data signal line of each of the pixels;

a correction value detecting circuit to supply a detection current to a source electrode of the driving transistor of a detection target pixel through a detection signal line and to detect a correction value; and a switch circuit including a first switching transistor to connect the detection signal line to the data signal line, the correction value detecting circuit to detect a threshold voltage of the driving transistor from a voltage of the source electrode of the driving transistor of the detection target pixel obtained when the driving transistor operates in a saturation region, or a voltage-current characteristic of the EL element from a voltage of the source electrode of the driving transistor of the detection target pixel obtained when the driving transistor operates in a linear region, wherein each of the pixels includes a switching transistor to connect, to the data signal line, the source electrode of the driving transistor of the detection target pixel and a source electrode of the driving transistor of each of remaining pixels in a same row as the detection target pixel, and to connect, to the power line, a source electrode of the driving transistor of each of the pixels in a different row from the detection target pixel, wherein the detection current is provided to the driving transistor of the detection target pixel from the data signal line by turning on the first switching transistor of the switch circuit, and a power supply voltage is provided to the driving transistor of the each of remaining pixels in the same row as the detection target pixel from the data signal line, and wherein, when the remaining pixels other than the detection target pixel emits light, the correction value detecting circuit detects a threshold voltage of the driving transistor or a voltage-current characteristic of the EL element in the detection target pixel.

3. The device as claimed in claim 2, further comprising:

wherein the switch circuit further comprises a second switching transistor to connect the data driver to the data signal line, and a third switching transistor to connect the power line to the data signal line, wherein the second switching transistor is turned on to connect the data signal line to the data driver during a data programming period in which a data voltage is written at a gate electrode of the driving transistor of each pixel; and wherein the third switching transistor is turned on to connect the data signal line to the power line during an emission period in which each of the pixels emit light, and the data signal line is connected to the correction value detecting circuit when a source current is supplied to the source electrode of the driving transistor of the detection target pixel.

* * * * *